US005351710A

United States Patent [19]

Phillips

[11] Patent Number: 5,351,710

[45] Date of Patent: Oct. 4, 1994

[54] INFLATION MECHANISM FOR INFLATABLE ARTICLE OF MANUFACTURE

[75] Inventor: Matthew L. Phillips, North Easton, Mass.

[73] Assignee: Reebok International Ltd., Stoughton, Mass.

[21] Appl. No.: 236,163

[22] Filed: May 2, 1994

Related U.S. Application Data

[63] Continuation of Ser. No. 973,670, Nov. 9, 1992, abandoned.

[51] Int. Cl.[5] ..... F16K 15/20

[52] U.S. Cl. ..... 137/223; 417/479; 36/88; 36/114; 251/322

[58] Field of Search ..... 417/479, 440, 441, 480; 36/114, 119, 88; 137/223, 230, 232, 233, 382, 377, 854; 5/449, 453, 454; 251/322; 222/402.3

[56] References Cited

U.S. PATENT DOCUMENTS

| | | | |
|---|---|---|---|
| 212,898 | 3/1979 | Class . | |
| 918,391 | 4/1909 | Taarud | 5/454 |
| 1,235,645 | 8/1917 | Hallock | 137/223 |
| 1,450,934 | 4/1923 | Wilson | 137/233 |
| 1,637,219 | 7/1927 | Edelmann . | |
| 2,368,091 | 1/1945 | Andersen . | |
| 2,476,545 | 7/1945 | Hayward . | |
| 2,579,977 | 12/1951 | Sjolin | 251/322 |
| 2,686,081 | 8/1954 | Cooksley | 222/402.13 |
| 2,717,556 | 9/1955 | Bartoo . | |
| 2,775,401 | 12/1956 | Storrs . | |
| 2,845,032 | 7/1958 | Krohm . | |
| 2,942,614 | 6/1960 | Lardner | 137/223 |
| 2,949,927 | 8/1960 | Mackal | 137/223 |
| 2,982,448 | 5/1961 | Leonard | 222/402.13 |
| 3,062,152 | 11/1962 | Huff, Sr. . | |
| 3,078,679 | 2/1963 | Mortimer et al. . | |
| 3,628,531 | 12/1971 | Harris | 128/142.5 |
| 3,983,907 | 10/1976 | Sorensen . | |
| 3,995,653 | 12/1976 | Mackal et al. | 137/234 |
| 4,014,048 | 3/1977 | Rappleyea . | |
| 4,169,353 | 10/1979 | Fresard . | |
| 4,457,335 | 7/1984 | Trick | 137/223 |
| 4,579,141 | 4/1986 | Arff . | |
| 4,669,498 | 6/1987 | Hansen . | |
| 4,681,148 | 7/1987 | Decker, Jr. et al. | 137/230 |
| 4,729,543 | 3/1988 | Aricha | 251/322 |
| 5,025,575 | 6/1991 | Lakic | 36/44 |
| 5,056,992 | 10/1991 | Simons et al. . | |
| 5,070,829 | 12/1991 | Guntly et al. . | |
| 5,074,765 | 12/1991 | Pekar | 417/480 |
| 5,083,320 | 1/1992 | Walstead | 2/413 |
| 5,083,581 | 1/1992 | Jaw . | |
| 5,113,599 | 5/1992 | Cohen et al. | 36/88 |
| 5,121,840 | 6/1992 | Schram . | |
| 5,129,107 | 7/1992 | Lorenzo | 2/413 |
| 5,155,864 | 10/1992 | Walker et al. . | |
| 5,155,865 | 10/1992 | Walker et al. . | |
| 5,155,866 | 10/1992 | Walker et al. . | |
| 5,158,767 | 10/1992 | Cohen et al. . | |

FOREIGN PATENT DOCUMENTS

| | | | |
|---|---|---|---|
| 0152401 | 2/1985 | European Pat. Off. . | |
| 2005365 | 9/1970 | Fed. Rep. of Germany . | |
| 2456612 | 6/1975 | Fed. Rep. of Germany . | |
| 3427644A1 | 1/1986 | Fed. Rep. of Germany | 36/119 |
| 2252820 | 6/1975 | France | 36/119 |
| 887832 | 1/1962 | United Kingdom | 137/223 |

*Primary Examiner*—Richard A. Bertsch
*Assistant Examiner*—Roland G. McAndrews, Jr.
*Attorney, Agent, or Firm*—Sterne, Kessler, Goldstein & Fox

[57] ABSTRACT

The present invention is an inflatable article of manufacture having inflation and fluid release mechanisms. The inflation mechanism generally comprises a pump and a resilient fluid intake valve. The fluid release mechanism includes a housing, a fluid release means and a protective cover which is received about the housing. The protective cover of the fluid release mechanism may also function as a connector for an "off board" inflation mechanism.

8 Claims, 8 Drawing Sheets

INFLATION MECHANISM FOR INFLATABLE ARTICLE OF MANUFACTURE

This application is a continuation of application Ser. No. 07/973,670, filed Nov. 9, 1992, now abandoned.

FIELD OF THE INVENTION

The present invention relates generally to an inflation and fluid release mechanism for an inflatable article of manufacture. More particularly the invention relates to a pump and fluid intake valve and to a cover for a fluid release mechanism.

BACKGROUND OF THE INVENTION

Recently, the use of inflatable devices within articles of manufacture has become widespread. For example, inflatable devices are now incorporated into a variety of athletic shoes, as well as various other types of athletic equipment such as protective helmets, apparel and baseball gloves. The inflatable devices used in conjunction with these articles of manufacture increasingly include an air-impervious bladder which is manually inflated by an inflation mechanism disposed on the article (i.e., the inflation mechanism is located "on board" the inflatable article of manufacture).

When an on board inflation mechanism is employed, it is imperative that the mechanism be as small as possible to minimize interference with the intended use of the article. However, as the size of the inflation mechanism is decreased, so is its ability to displace fluid and pump the same into the inflatable bladder. Thus, a highly efficient inflation mechanism (that is, one which completely displaces its maximum fluid volume to an inflatable bladder) is desired.

One inflation mechanism which has been successful in footwear is formed of a latex rubber bulb which includes an integral one-way inlet valve. The inlet valve typically extends outwardly from one side of the bulb. Disposed on the opposite side of the bulb is an outlet mechanism which transfers fluid (air) from the latex bulb to the inflatable bladder.

U.S. Pat. No. 5,074,765 to Pekar discloses a dome-like air pump which is formed from a resilient, elastomeric material capable of being bonded to an opening in an inflatable bladder. The pump is provided with an inlet flapper type valve which is integrally formed in a wall of the pump. An outlet check valve of the "duck-bill" type extends through an opening located in the base of the pump to transfer air from the pump to the inflatable bladder.

It is a principal object of the present invention to provide an inflation mechanism for an inflatable article of manufacture which is of simple, compact construction and operationally reliable.

Another object of the invention is to provide an inflation mechanism for an inflatable article of manufacture which is capable of being easily integrated with an inflatable bladder.

A further object of the invention is to provide an inflation mechanism of low profile which may be adapted for use with any type of inflatable article of manufacture, is durable, reliable and most importantly efficient.

The Pekar patent also discloses an inflatable bladder having a fluid exhaust valve affixed thereto. The fluid exhaust valve includes a stem with an actuator plunge and a spherical closure member. The component parts of the fluid exhaust valve are housed within an opening through a boss molded integral with the bladder. The upper portion of the component parts, however, are exposed to the atmosphere (i.e., they are not completely disposed within the housing). Thus, dust and other particulate matter (which could interfere with operation of the valve) may enter the fluid exhaust valve via this unprotected area.

Accordingly, an object of the present invention is to provide a protective cover for a fluid release valve which is lightweight and does not interfere with operation of the valve.

Another object of the invention is to provide a means by which an alternate inflating mechanism may be coupled to the inflatable article of manufacture.

SUMMARY OF THE INVENTION

In accordance with the objects and purposes of the present invention as described and embodied herein, the present invention is an inflatable article of manufacture having a bladder, an inflation mechanism, and a fluid intake valve. The inflation mechanism includes a substantially planar bottom surface, at least one substantially vertical side wall, and a convex or dome-like top surface. Together, the top surface, bottom surface and side wall define a hollow interior which is capable of containing a fluid.

A fluid intake valve is disposed adjacent to and is in fluid communication with the inflation mechanism. The fluid intake valve comprises a substantially planar lower surface, at least one vertical side wall, and an upper surface which defines a centrally disposed aperture and several fluid inlet apertures. The lower surface, side wall, and upper surface define a cavity. Within this cavity, a flutter member is disposed. The flutter member includes a flat, circular head portion and a stem portion having a stop member which extends through and abuts against the centrally disposed aperture of the intake valve to maintain the head portion of the flutter member in close proximity to the valve upper surface.

When inflation of the article of manufacture is desired, a force is applied to the top surface of the inflation mechanism. This force creates increased pressure within the interior of the inflation mechanism and intake valve. The increased pressure therein urges the head portion of the flutter member toward the upper surface of the intake valve to cover the fluid inlet apertures and prevent fluid from exiting the same. Thus, because fluid within the inflation mechanism is unable to pass through the fluid inlet apertures during application of a force to the top surface of the inflation mechanism, most of the fluid within the mechanism is forced by displacement into the bladder portion of the inflatable article of manufacture to efficiently inflate the same. Upon release of the force, the pressure within the inflation mechanism drops, the head portion of the flutter member moves away from the upper surface of the intake valve, and fluid passes into the interior of the inflation mechanism through the fluid inlet apertures of the fluid intake valve.

In another aspect of the present invention, the inflation mechanism includes a pump and a fluid intake valve in fluid communication with the pump, and a fluid release mechanism. The fluid intake valve includes a planar lower surface, at least one vertical side wall, and an upper surface which defines at least one fluid inlet aperture. The lower surface, side wall and upper surface of the intake valve define a space therebetween. A means for preventing the escape of fluid from the pump when a force is applied thereto is positioned within this space and is biased toward the upper surface of the intake valve.

In another aspect, the present invention is an inflatable article of manufacture including an inflatable bladder portion, an inflation mechanism, and a fluid release mechanism. The fluid release mechanism compris housing, a means for releasing fluid from the inflatable article of manufacture, and a cover which is received about the housing. The fluid releasing means is positioned within the housing of the fluid release mechanism. A top surface and side wall of the cover define an interior area therein. A means for limiting the extent to which the cover is received about the housing is positioned within the interior of the cover.

In yet another aspect of the invention, the inflatable article of manufacture includes a bladder portion, an inflation mechanism, and a fluid release mechanism. The fluid release mechanism includes a housing, a means for releasing fluid from the bladder, and a cover. The means for releasing fluid is positioned within the housing of the mechanism. The cover is received about the housing and includes a top surface, at least one side wall, and at least one fluid escaping aperture.

BRIEF DESCRIPTION OF THE DRAWINGS

The foregoing and other aspects and features of the present invention will be more fully understood from the following detailed description of the present invention when considered in conjunction with the accompanying drawings, in which.

DETAILED DESCRIPTION OF THE PREFERRED EMBODIMENT

Reference will be made in detail below to the preferred embodiment of the present invention illustrated in the accompanying drawings. It should be noted that similar or identical structure is identified using identical reference numbers.

Figure 1:
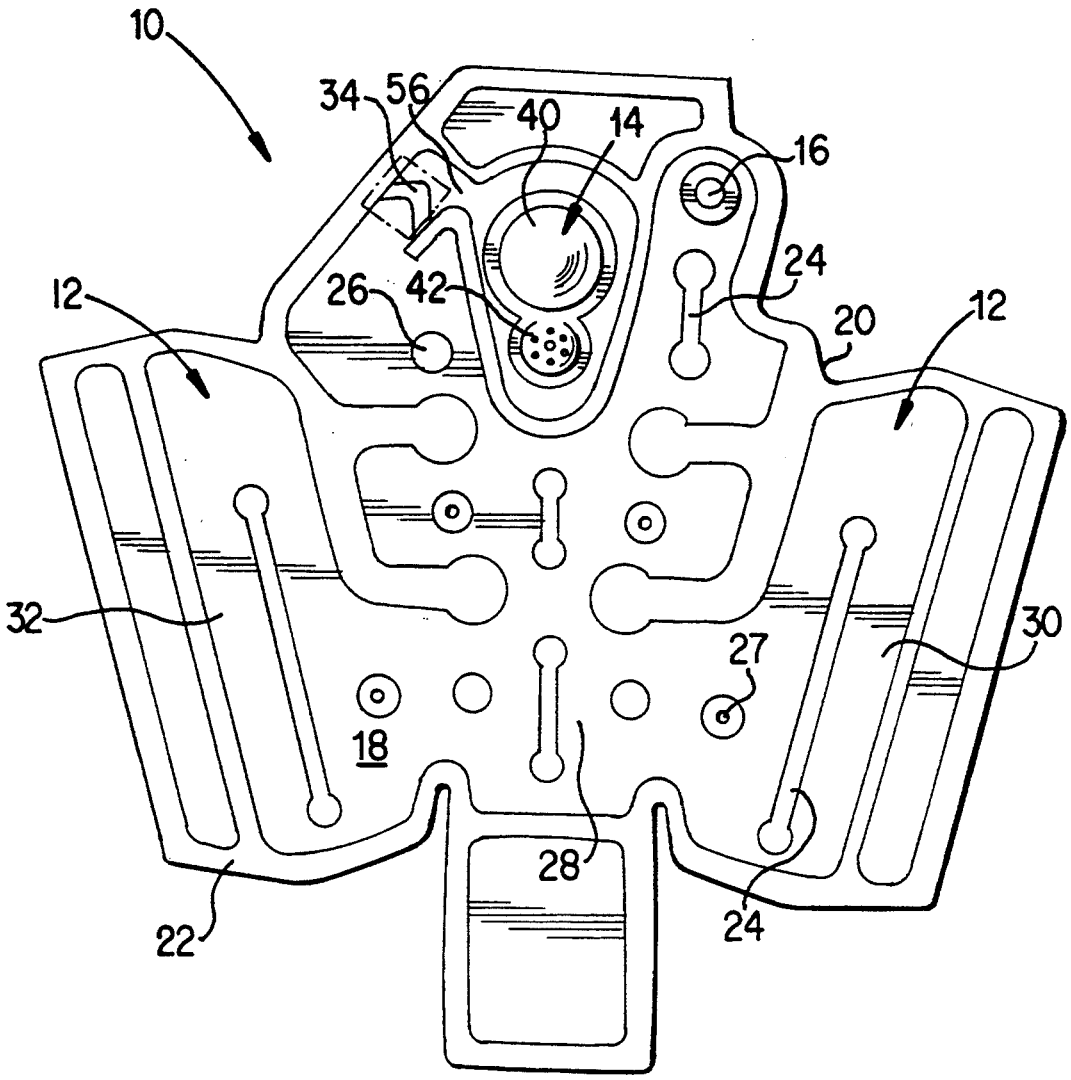
FIG. 1 illustrates an inflatable device for an article of manufacture which incorporates the inflation mechanism and fluid intake valve of the present invention.
Figure 2:
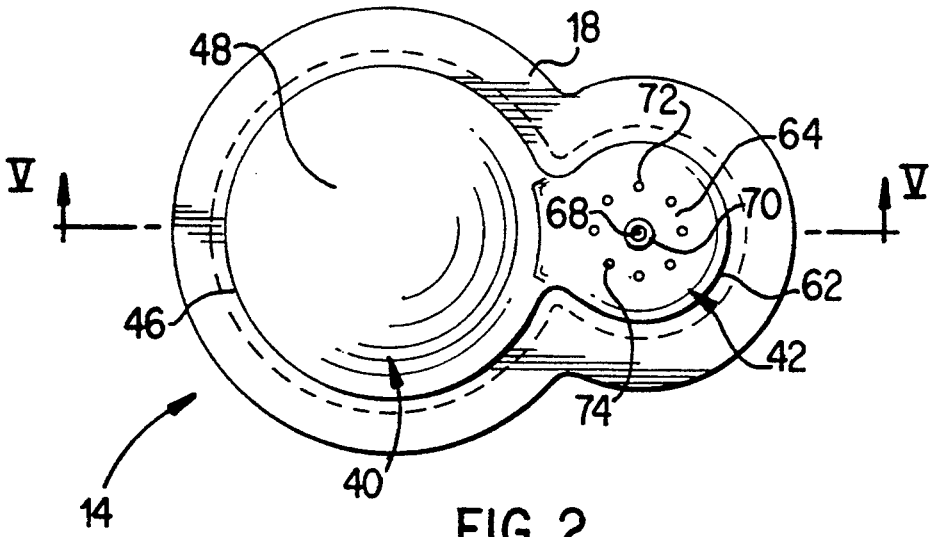
FIG. 2 is a top plan view of the inflation mechanism of the present invention.
Figure 3:
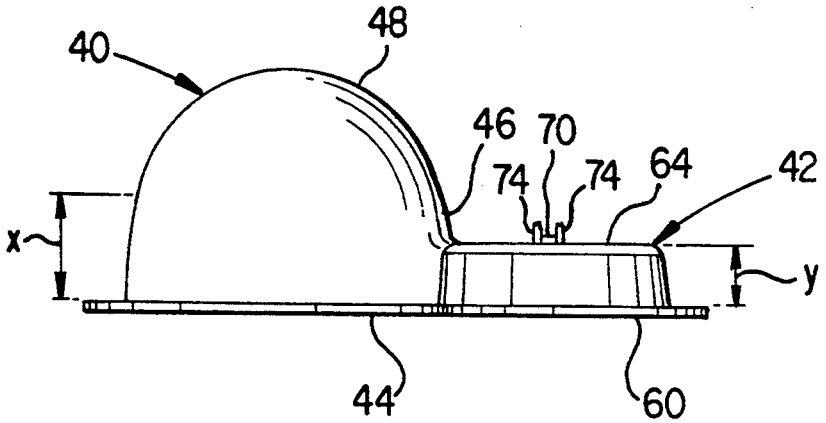
FIG. 3 is a side elevational view thereof.
Figure 4:
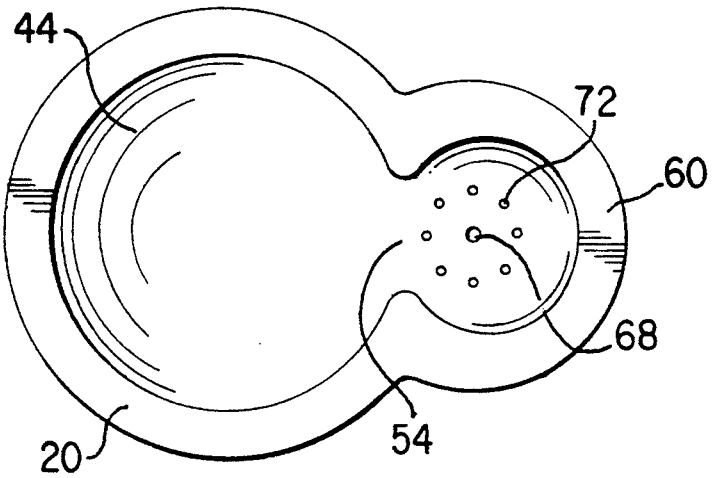
FIG. 4 is a bottom plan view thereof.

Referring now to the preferred embodiment of the invention, an inflatable device for an article of manufacture is shown generally at 10 in FIG. 1. The illustrated inflatable device has been constructed for use with an athletic shoe (specifically, the tongue portion thereof). The inflatable device generally comprises an inflatable bladder 12, an inflation mechanism 14 and a fluid release mechanism 16.

Bladder 12 is comprised of a number of component pans which include a first film or layer 18 and a coextensive second film or layer 20. The first and second layers are preferably made from a lightweight, elastic material such as thermal-polyurethane film available from Stevens Elastomerics, Inc., Northampton, Mass. In the preferred embodiment, the first: and second layers are approximately 0.3 mm thick.

First layer 18 and coextensive second layer 20 are attached along their common peripheral edge 22 to form a fluid impervious bladder 12. One example of a suitable method of attachment is by application of high radio frequency (rf) energy to the edges of the first and second layers. It should be realized by those skilled in the art that bladder 12 may be welded between coextensive sheets 18 and 20 and then die cut to the desired shape, or the bladder pattern may be cut first and welded thereafter.

As illustrated in FIG. 1, interior weld lines 24 and circular welds 26 are provided throughout bladder 12 to control inflation of the bladder in selected areas. Because the illustrated bladder is to be utilized with a shoe tongue, the density of weld lines and circular welds is relatively high since it is not desirable for the tongue to obtain a substantial thickness. If, however, a bladder of substantial thickness is desired, the density of weld lines and/or circular welds would be relatively low. Weld lines 24 and circular welds 26 may be formed by rf welding, or they may be formed by any other suitable adhering operation which still allows fluid to flow throughout the bladder to inflate the same. If desired, aeration holes 27 may be provided in the bladder by punching out the central portions of circular welds 26. Because the welds are circular and do not enable air to pass therethrough, the holes can be placed within the welds without risk of fluid leakage. First film 18 and second film 20 are otherwise not attached to enable a pocket or bladder to be formed which allows fluid to be introduced between the two films.

Bladder 12 generally includes a central region 28, a medial region 30, and a lateral region 32. If desired, each of these regions may be further compartmentalized to additionally control inflation of bladder 12. It should be apparent to those skilled in the art that bladder 12 may take any shape and may include any number of weld lines and/or circular welds. Generally, however, the shape and thickness of the bladder is dictated by the article of manufacture into which the bladder is ultimately incorporated.

Figure 5:
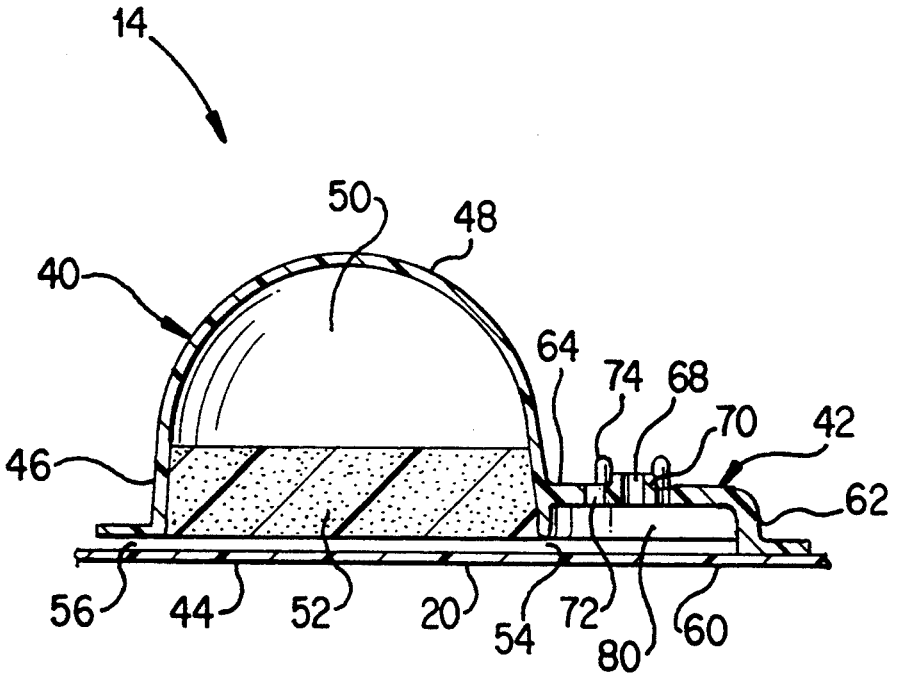
FIG. 5 is a cross-section view thereof.
Figure 7:
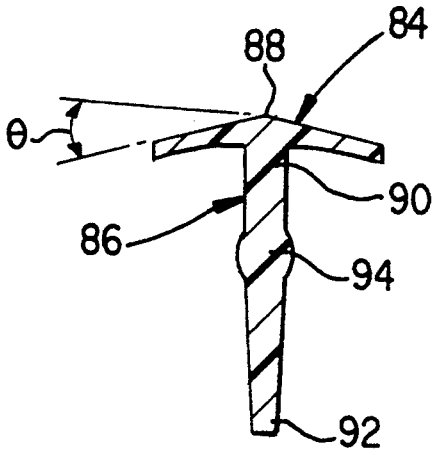
FIG. 7 is a cross-section view thereof.
Figure 6:
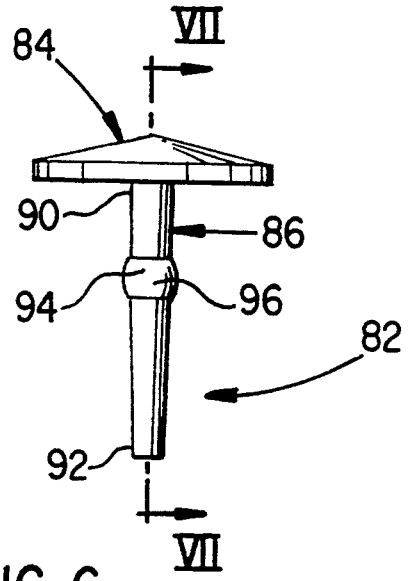
FIG. 6 is a side elevational view of the flutter member of the intake valve.

At the upper portion of bladder 12, inflation mechanism 14 of the present invention is shown in fluid communication with the bladder. With reference now to FIGS. 1–5, inflation mechanism 14 is comprised of a resilient, elastomeric pump 40 and a fluid intake valve 42 which are molded substantially as a unitary structure and affixed to bladder 12 by rf welding, tier example. Pump 40 comprises a substantially planar bottom surface 44, a substantially vertical side wall 46, and a convex or dome-like top surface 48. As shown in FIG. 5, bottom surface 44 is formed by second film 20 of bladder 12. Top surface 48 and side wall 46 are integrally formed by a resilient, elastic film similar to films 18 and 20. However, the thickness and hardness of the film used to form top surface 48 and sidewall 46 is greater than films 18 and 20 (approximately 0.5 mm thick and a Shore A durometer hardness of 85) to render pump 40 self-supporting and to provide the pump with increased resiliency and shape retention qualities.

In the preferred embodiment, top surface 48 is circular in plan and has a radius of curvature of 0.500 radius tangent to 7° 28′ angle descending to 1.074 diameter (O.D.). However, top surface 48 may be otherwise appropriately sized to allow operation of pump 40 by a finger, hand, toe or foot. Side wall 46 is generally cylindrical in cross-section and has a preferred height X (shown in FIG. 3) of 8 mm. Although pump 40 is shown as having a single cylindrical side wall, it is to be understood that a plurality of side walls having any suitable shape may also be utilized.

Together bottom surface 44, side wall 46 and top surface 48 define a hollow interior 50 having a volume of approximately 7.5 cc. Preferably, a resilient, open-celled foam 52 having a porosity of 25–35 ppi (pores per inch) is disposed within hollow interior 50 to assist top surface 48 in returning to its original shape upon removal of a force applied thereto. A foam suitable for this purpose is open-celled reticulated polyurethane foam available from Rogers Foam, Georgetown, Massachusetts (product no. P-0155).

Provided near bottom surface 44 of pump 40 is a fluid inlet 54 which is generally formed by a void in side wall 46. Disposed opposite of fluid inlet 54 is a fluid outlet 56 through which fluid displaced by pump 40 passes. As best seen in FIG. 1, fluid outlet 56 is formed by welding first film 18 to second film 20 in a particular manner. Fluid outlet 56 allows pump 40 to be in fluid communication with bladder 12 at the upper region thereof. Naturally, pump 40 may be fluidly connected to bladder 12 in a location other than that disclosed in FIG. 1. For example, the pump may be located in any area which does not interfere with the intended use of the inflatable article of manufacture.

With continuing reference to FIGS. 1–5, disposed in fluid communication with pump 40 is a fluid intake valve 42. Fluid intake valve 42 is formed generally by a substantially planar lower surface 60, at least one vertical side wall 62, and an upper surface 64. Similar to pump 40, lower surface 60 of intake valve 42 is formed by elastic second film or layer 20. Side wall 62 and upper surface 64 are integrally formed by the film used to form top surface 48 and side wall 46 of pump 40.

In the preferred embodiment, upper surface 64 is substantially planar and is circular in plan. Side wall 62 is generally cylindrical in cross-section and has a preferred height Y (see FIG. 3) of 4.4 mm. Although intake valve 42 is shown having a single cylindrical side wall, it is to be understood that a plurality of side walls having any suitable shape may also be utilized.

Upper surface 64 defines a centrally disposed aperture 68 having a diameter of preferably 1.65 mm. Aperture 68 is surrounded by a cylindrical wall 70 which extends approximately 1.6 mm above upper surface 64. Wall 70 is provided to support the one-way check valve of the fluid intake valve which will be described in more detail below.

Upper surface 64 also defines a plurality of fluid inlet apertures 72 which allow intake valve 42 to be in fluid communication with the atmosphere. Fluid inlet apertures 72 are approximately 1.5 mm in diameter and are preferably disposed equiangularly about upper surface 64. Although three fluid inlet apertures are shown, it should be realized by those skilled in the art that any number of inlet apertures may be used which allows fluid to easily flow into the intake valve.

With continuing reference to FIGS. 2–5, molded upon upper surface 64 are a plurality of projections or pillars 74. Projections 74 are formed preferably from a thermal-polyurethane having a Shore A durometer hardness of approximately 85. Such a material is available from Stevens Elastomerics. Inc. or Dow Chemical Corp. Projections 74 are provided to ensure that intake valve 42 operates in an unobstructed manner. For example, if a cover is to be disposed over inflation mechanism 14, projections 74 prevent the undersurface of the cover from coming into contact with the intake valve and thereby rendering the same inoperative. To achieve the desired result, however, projections 74 should be at least 2.0 mm in height and equiangularly spaced (at an angle of approximately 90°) about upper surface 64.

Figure 9:
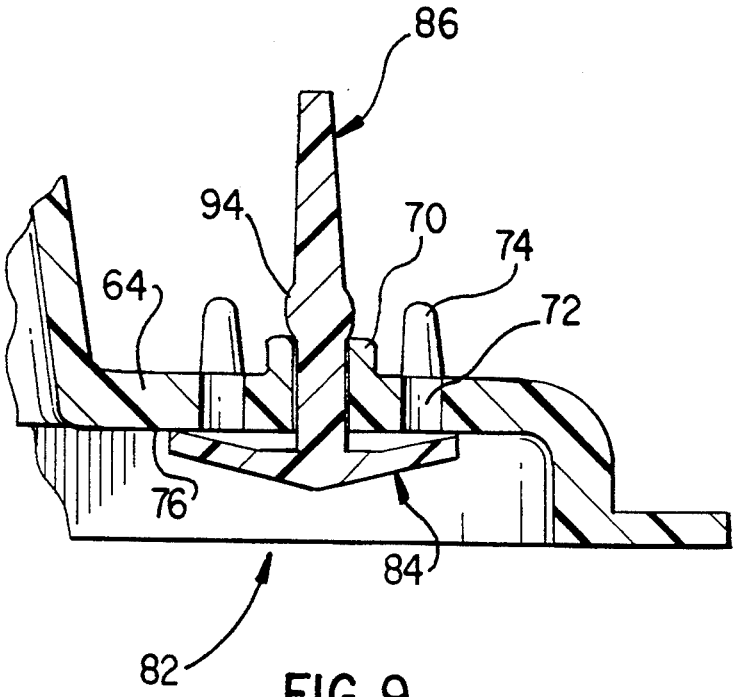
FIG. 9 is a cross-section view of the flutter member positioned within the cavity of the intake valve.

Together lower surface 60, side wall 62 and upper surface 64 define a cavity 80. Within cavity 80, a flutter member 82 is disposed (see FIG. 9) which functions as a one-way check valve to prevent fluid from exiting inflation mechanism 14 when it is in an active condition (i.e., when a force is being applied to pump 40).

With reference now to FIGS. 6–9 flutter member 82 will now be described. Flutter member 82 is generally umbrella-shaped in vertical cross-section and is preferably formed from a thin, flexible resilient material such as a silicone elastomer available from Robin Industries, Cleveland, Ohio. Obviously, other materials having the aforementioned characteristics may also be used.

Flutter member 82 includes a flat, circular (in plan) head portion 84 and a stem portion 86. Head portion 84 is approximately 10.21 mm in diameter. From locus 88, head portion 84 is molded at an angle $\theta$ of preferably 14.5°. Stem portion 86 generally tapers in width from proximal end 90 to distal end 92. It is approximately 11.10 mm in length and includes a spherical stop member 94 (positioned at approximately midpoint 96) which maintains flutter member 82 in its proper position within cavity 80. Flutter member 82 is "loaded" into cavity 80 by pulling stem portion 86 through centrally disposed aperture 68. The flutter member is correctly positioned when stop member 94 abuts against cylindrical wall 70 and head portion 84 lies just below interior surface 76 of upper surface 64 and just beneath fluid inlet apertures 72 (see FIG. 9). Because the diameter of stop member 94 is greater than that of aperture 68, flutter member 82 is prevented from falling through aperture 68 to the bottom of intake valve 42. Thus, due to the specific structure and positioning of flutter member 82 within the intake valve, it is prepared to prevent fluid backflow from pump 40 before application of a force to the same.

Figure 8:
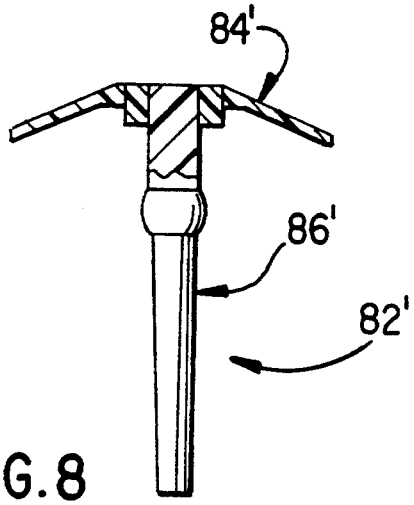
FIG. 8 is a partial cross-section view of an alternate embodiment of the flutter member.

Illustrated as 82′ in FIG. 8 is an alternate embodiment of the flutter member of the present invention. Flutter member 82′ is similar to flutter member 82 except that head portion 84′ and stem portion 86′ are separately formed and molded together.

Having described in detail the components of inflation mechanism 14, the operation of the mechanism 14 will now be discussed. When the inflation mechanism is in an inactive state (that is, when there is no force being applied to the top surface of the pump), air at atmospheric pressure is contained within the pump and fluid intake valve. Because the head portion of the flutter member lies just below the upper surface of the intake valve and does not cover the fluid inlet apertures, air, at atmospheric pressure, is contained within the pump and fluid intake valve. Due to the open-celled nature of the foam member disposed within the hollow interior, the interior of the pump may be completely filled with air.

To inflate the bladder with the air contained in the pump, the user applies a force to the convex top surface thereof. As the top surface of the pump inverts, the pressure within the entire inflation mechanism increases. This increase in pressure forces the flexible head portion of the flutter member into direct contact with the upper surface of the intake valve to cover the fluid inlet apertures formed therein. Thus, as the pump is depressed, the intake valve closes and air within the pump is prevented from flowing out of the fluid inlet apertures by the head portion of the flutter member. As a result, the air (having only one available flow path) passes into the bladder through the fluid outlet of the pump to inflate the same.

Upon releasing the force applied to the pump, the pump tends to return to its original shape. As it begins to return to its shape, the volume within the inflation mechanism increases and the pressure drops below ambient pressure. The head portion of the flutter member is forced away from the upper surface of the intake valve by the ambient pressure to allow air to freely enter the inflation mechanism through the now unobstructed fluid inlet apertures. If additional inflation is desired, the user simply continues to apply and release force to the top surface of the pump until the desired amount of inflation is achieved.

A second one-way check valve to prevent leakage of air within the bladder is provided. With reference to FIG. 1, second one-way check valve 34 is shown. The second check valve utilizes two sheets of a thin, resilient material (shown in phantom) to prevent fluid already within the bladder from flowing back into the inflation mechanism. Thus, an inflatable article of manufacture utilizing the fluid intake valve of the present invention and the second one-way check valve discussed above is highly efficient due to the ability of the valves to prevent fluid leakage at all fluid inlet/outlet ports of the inflation mechanism. Moreover, the inflation mechanism is comprised of relatively few component parts, is easy to construct, and is operationally reliable.

Figure 10:
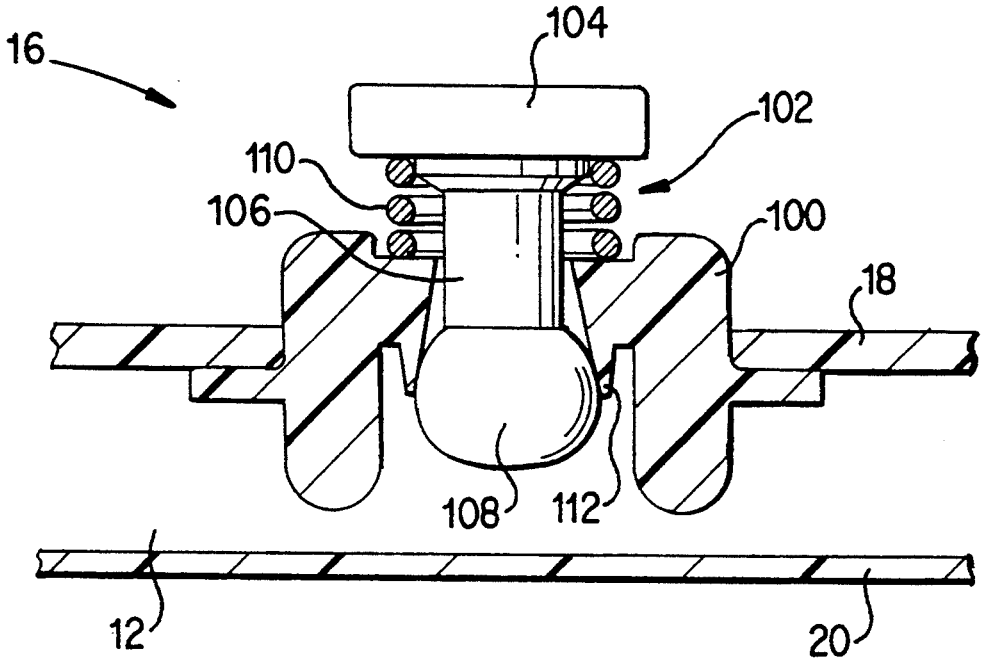
FIG. 10 is a cross-section view of the fluid release mechanism.

The inflatable article of manufacture may also be provided with a fluid release mechanism to vent the inflatable bladder of air contained therein. With reference now to FIG. 10, the fluid release mechanism of the present invention is shown generally at 16. Fluid release mechanism 16 is in fluid communication with bladder 12 and the atmosphere to enable venting or deflating of the bladder. While the fluid release mechanism may be located anywhere on bladder 12, it is preferable that the mechanism be located where it can be conveniently activated by the user. The release mechanism of FIG. 10 includes a housing 100 and a means 102 for releasing fluid from bladder 12. Fluid releasing means 102 is securingly positioned within housing 100.

Housing 100 is preferably formed from a molded thermal-polyurethane so that it may be easily attached (by rf welding, for example) to first film 18. Fluid releasing means 102 is comprised of a plunger 104 having a stem portion 106 and a stop member 108. A coil spring 110 is disposed about the stem portion of plunger 104 to bias fluid releasing means 102 in the shown closed position. As shown in FIG. 10, when plunger 104 is in the closed position, stop member 108 of plunger 104 abuts against an annular shoulder 112 of housing 100 to prevent leakage of air from the bladder. The components of the fluid release means may be made out of a number of materials including plastics or lightweight metals (such as aluminum).

Securingly received about fluid release mechanism 16 is a protective cover 120 (see FIGS. 11–14). Cover 120 is employed to prevent dirt and other particulate matter from entering the fluid release mechanism which may interfere with use of the same. The cover, however, may also serve as a nipple or connector for use with an "off board" inflation mechanism, such as that disclosed in co-pending U.S. application Ser. No. 07/828,440 the disclosure of which is herein incorporated by reference.

Cover 120 is preferably formed from an easily moldable, elastic material having a thickness of approximately 1.0 min. ESTANE TM, available from B.F. Goodrich or PELLETHANE TM, available from Dow Chemical Corporation are both suitable products for forming the cover. Cover 120 includes a top surface 122, a side wall 124, a flange 126, and an engaging rim 128. Top surface 122 has a diameter of approximately 9.69 mm and includes a 5.0 mm boss standing 0.5 mm high from surface 122. Side wall 124 is slightly angled and is approximately 5.0 mm high. Obviously, the dimensions of the top surface and side wall are dictated by the outer dimensions of the fluid release mechanism. Together, top surface 122 and side wall 124 define an interior area 130 which receives the fluid release mechanism when the cover is positioned thereon.

Figure 11:
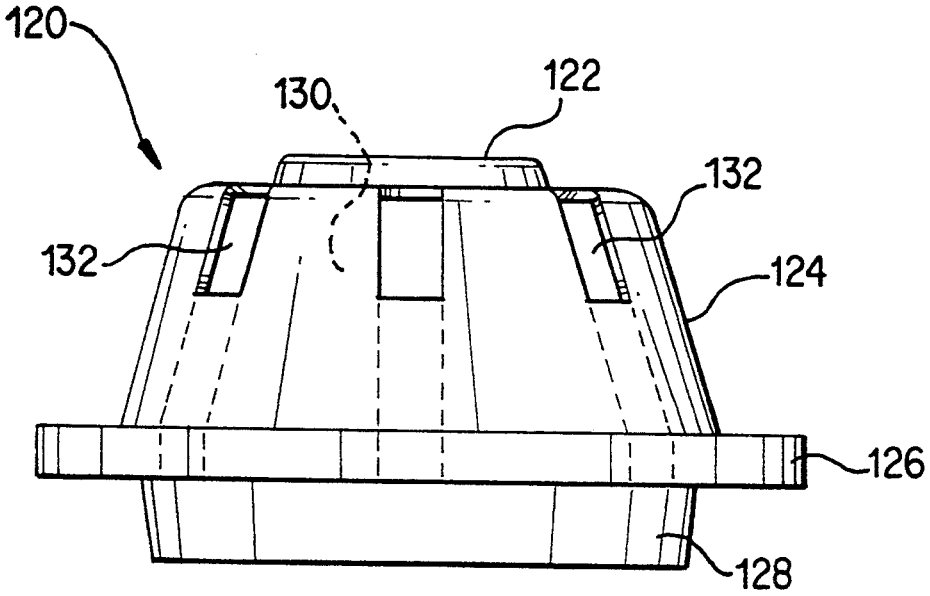
FIG. 11 is a side elevational view of a cover for the fluid release mechanism of FIG. 10.
Figure 12:
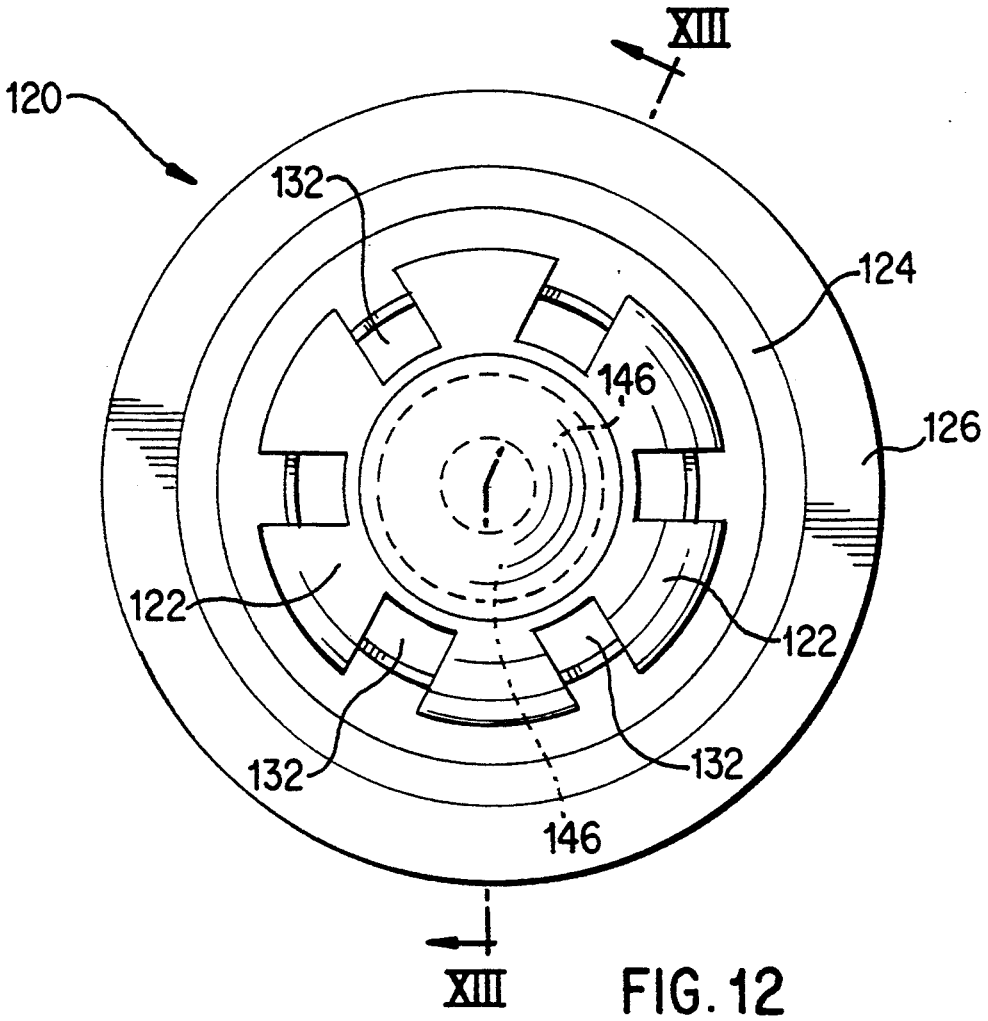
FIG. 12 is a top plan view thereof.

As best seen in FIGS. 11 and 12, defined within the top surface and side wall of the cover are several fluid escaping apertures 132. Preferably, cover 120 includes six fluid escaping apertures which are equiangularly spaced about the common edge of top surface 122 and side wall 124. Naturally, any number of fluid escaping apertures may be used which allows fluid to be vented from within the bladder of the present invention. Fluid escaping apertures 132 are approximately 2.4 mm in length and 1.5 mm in width. Top surface 122 may include a centrally disposed aperture (not shown) which is provided to receive an inflating needle of an off board inflation mechanism mentioned above. The diameter of the aperture is preferably slightly larger than that of tile inflating needle of the off board inflation mechanism.

Figure 13:
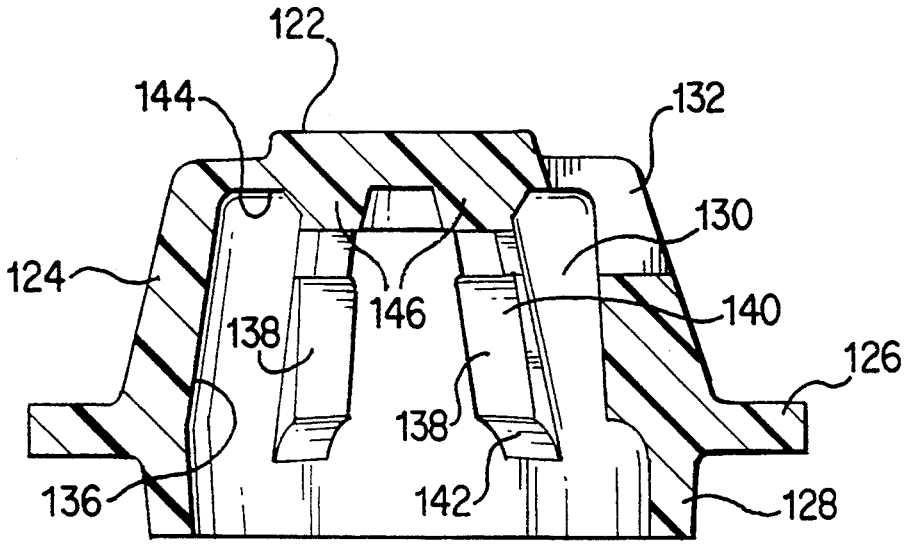
FIG. 13 is a cross-section view thereof taken along line XIII—XIII of FIG. 11.

Turning now to FIG. 13, the internal components of cover 120 are shown. Molded onto internal surface 136 of side wall 124 are several vertical ribs 138. At their upper region 140, ribs 138 engage with the side portion of plunger 104 to provide positive interaction or contact with the same. At their lower region 142, ribs 138 are beveled to provide positive interaction or contact with housing 100 and to limit the extent to which cover 120 is received about fluid release mechanism 16. Preferably, ribs 138 are molded directly beneath fluid escaping apertures 132 and are approximately 1.5 mm thick, 1.5 mm wide and 2.3 mm long.

Molded onto internal surface 144 of top surface 122 is a ring-like projection 146 which comes into contact with plunger 104 when a force is applied to the top surface of the cover. The projection is provided to assist in the depression of the plunger when release of the fluid in the bladder is desired. Although the projection is illustrated as a ring, it should be realized by those skilled in the art that multiple projections of any shape (which do not interfere with the escape of fluid in the mechanism) may be provided.

Figure 14:
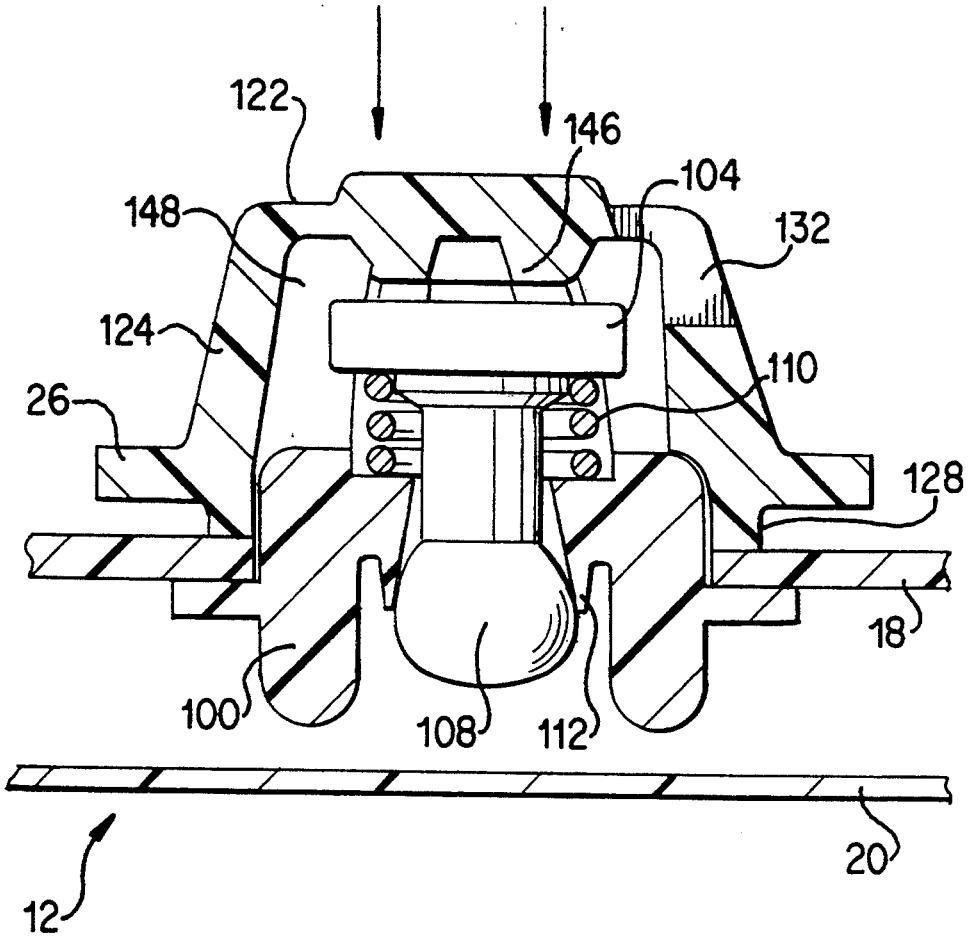
FIG. 14 is a cross-section view of the cover received about the fluid release mechanism.

With reference now to FIG. 14, the cover of the present invention is shown received about fluid release mechanism 16. Rim 128 is received and secured (via rf welding) to first film or layer 18. Flange 126 is not flush with first film 18, but instead rests a distance thereabove to allow a suitable upper material (such as leather, nylon or canvas) to be placed beneath the cover. If the user wishes to vent the bladder of air contained therein, a force (in the direction of the arrows) is applied to top surface 122 of the cover. As the top surface is depressed (for example, by the finger or hand), ring-like projection 146 comes into contact with plunger 104 to depress the same and open the fluid release mechanism. As the top surface of the cover is depressed, side wall 124 bows outwardly and ribs 138 move away from housing 100 to open up the space between the fluid release mechanism and the cover. As the fluid release mechanism is opened, stop member 108 moves away from annular shoulder 112 and air flows around the stop member and stem 106 and into space 148. The air, now within the confines of cover 120, escapes therefrom by flowing out of the fluid escaping apertures provided within the wall and top surface of the cover. When the desired amount of air has been vented from the bladder, the user removes the force from the top surface of the cover, projection 146 moves away from plunger 104, and coil spring 110 (biased about plunger 104) brings stop member 108 back into contact with annular shoulder 112. The fluid releasing means is now in the closed position to prevent air from exiting the bladder of the inflatable article of manufacture. Thus, the lightweight cover of the present invention efficiently functions as a protective means to ensure operational reliability of the fluid release mechanism. In combination, the inflation and fluid release mechanisms of the present invention allow the inflatable article of manufacture to be lightweight, easily constructable, and highly efficient.

Figure 15:
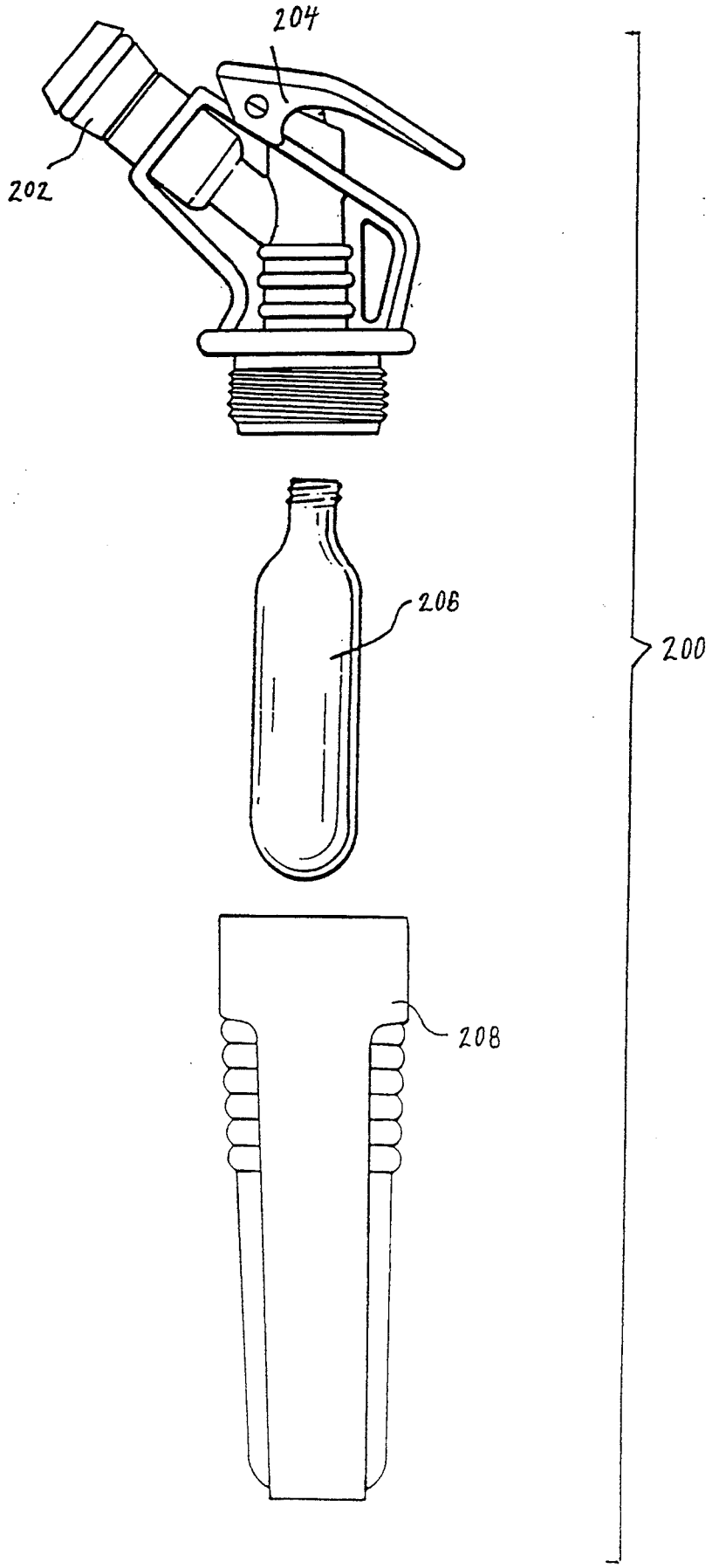
FIG. 15 is a side elevational view of an off-board inflation mechanism comprising a source of pressurized gas.

Alternatively, and as mentioned heretofore, the cover of the present invention may also function as a connector or coupling means for an off board inflation means. The off board inflation mechanism described in U.S. application Ser. No. 07/828,440 is shown in FIG. 15 as element 200. Off board inflation mechanism 200 includes a nozzle 202, a lever 204, a cartridge of pressurized gas 206 and a cartridge housing 208. The inflation mechanism is utilized with the cover of the present invention in the following manner. To inflate the bladder within the inflatable article of manufacture, the nozzle of the off board inflation mechanism is disposed about cover 120. As the nozzle is fitted onto the cover, the depressing pin of the off board inflation mechanism engages with the top surface of the cover to depress the same. As the top surface is depressed, ring-like projection 146 comes into contact with plunger 104 to open the fluid release mechanism in the manner heretofore described. When the fluid release mechanism has been properly opened by the depressing pin, fluid from the off board inflation mechanism is released through the nozzle. This fluid enters the cover through fluid escaping apertures 132 and enters the bladder through the now opened fluid release mechanism. When the bladder has been inflated to the desired amount, the nozzle is removed from the cover and the absence of the depressing pin allows the fluid release means to return to the closed position to seal the inflating fluid within the bladder. Thus, when the fluid release mechanism and cover are also used a connector for an off board inflation mechanism, the resulting article of manufacture is lightweight, requires less assembly of component parts, and is highly efficient.

The foregoing description of the preferred embodiments of the invention has been presented for purposes of illustration only. It is not intended to be exhaustive or to limit it to the precise form disclosed. Obviously, many modifications and variations may be made in light of the above teachings. It is intended that the scope of the invention be defined by the claims appended hereto.

We claim:

1. An inflatable article of manufacture, comprising:
(1) a bladder,
(2) a valve, comprising
(a) a housing,
(b) means for controlling fluid entering and exiting said valve, said means being positioned within said housing, and
(c) a cover securingly received about said housing of said valve, said cover comprising
(i) a top portion having thickness,
(ii) at least one side wall, and
(iii) at least one fluid aperture extending through said thickness of said top portion of said cover to provide a fluid passageway between said valve and the atmosphere,
wherein said cover is configured to be removably coupled to an inflation mechanism to inflate said bladder.

2. The inflatable article of manufacture of claim 1, wherein said inflation mechanism is an off board inflation mechanism comprising a source of pressurized gas.

3. The inflatable article of manufacture of claim 1, wherein said cover is formed from an elastic, resilient material.

4. The inflatable article of manufacture of claim 3, wherein said material is thermal-polyurethane.

5. The inflatable article of manufacture of claim 1, further comprising a means for limiting the extent to which said cover is received about said housing.

6. The inflatable article of manufacture of claim 5, wherein said means for limiting the extent to which said cover is received about said housing is positioned on an interior surface of said side wall.

7. The inflatable article of manufacture of claim 1, further comprising at least one projection to assist in activating said valve.

8. The inflatable article of manufacture of claim 7, wherein said projection is disposed on an interior surface of said top surface.

* * * * *